US010276974B2

(12) United States Patent
Wei

(10) Patent No.: US 10,276,974 B2
(45) Date of Patent: Apr. 30, 2019

(54) PLUG CONNECTOR WITH LOCKING AND GROUNDING STRUCTURES

(71) Applicant: LOTES CO., LTD, Keelung (TW)

(72) Inventor: Xin Zheng Wei, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/805,250

(22) Filed: Nov. 7, 2017

(65) Prior Publication Data

US 2018/0145449 A1 May 24, 2018

(30) Foreign Application Priority Data

Nov. 23, 2016 (CN) ..... 2016 2 1258169 U

(51) Int. Cl.

| | |
|---|---|
| ***H01R 13/627*** | (2006.01) |
| ***H01R 13/428*** | (2006.01) |
| ***H01R 13/6581*** | (2011.01) |
| ***H01R 13/66*** | (2006.01) |
| ***H01R 13/658*** | (2011.01) |
| ***H01R 13/6583*** | (2011.01) |
| ***H01R 24/60*** | (2011.01) |
| *H01R 4/02* | (2006.01) |

(52) U.S. Cl.

CPC ..... *H01R 13/6273* (2013.01); *H01R 13/428* (2013.01); *H01R 13/6581* (2013.01); *H01R 13/6583* (2013.01); *H01R 13/65802* (2013.01); *H01R 13/6683* (2013.01); *H01R 24/60* (2013.01); *H01R 4/023* (2013.01)

(58) Field of Classification Search

CPC ..... H01R 4/64; H01R 23/688; H01R 4/646; H01R 13/6275; H01R 23/6873; H01R 13/658; H01R 23/7073

USPC ... 439/92, 98, 101, 108, 350, 607.35, 607.4, 439/607.45, 607.55, 660

See application file for complete search history.

(56) References Cited

U.S. PATENT DOCUMENTS 6,056,578 A * 5/2000 Lin ..... H01R 13/514 439/358
6,799,986 B2 * 10/2004 Igarashi ..... H01R 13/6275 439/358

(Continued)

FOREIGN PATENT DOCUMENTS

CN 204167559 U 2/2015
CN 205070058 U 3/2016

(Continued)

*Primary Examiner* — Thanh Tam T Le

(74) *Attorney, Agent, or Firm* — Locke Lord LLP; Tim Tingkang Xia, Esq.

(57) ABSTRACT

A plug connector includes an insulating body having a mating portion, a ground terminal, and a latch member. A mating slot is disposed in the mating portion. The ground terminal has a first contacting portion protruding and extending into the mating slot, and a first tail portion. The latch member has a connecting portion and two locking arms located on two sides of the connecting portion. The first tail portion is in contact with the connecting portion, or in contact with the locking arms. Plate surfaces of the first tail portions are perpendicular to plate surfaces of the locking arms. The locking arms are located on two sides of the mating portion and respectively have a locking portion protruding and extending into the mating slot. The locking portions are used for engaging with buckling slots of a tongue.

31 Claims, 19 Drawing Sheets

(56) References Cited

U.S. PATENT DOCUMENTS

| | | | | |
|---|---|---|---|---|
| 7,618,285 | B2 * | 11/2009 | Xiang | H01R 13/512 439/541.5 |
| 7,909,632 | B2 * | 3/2011 | Wu | H01R 9/03 439/353 |
| 8,556,648 | B2 * | 10/2013 | Wu | H01R 13/5213 439/276 |
| 8,597,060 | B2 * | 12/2013 | Wu | H01R 13/6471 439/660 |
| 8,662,933 | B2 * | 3/2014 | Wu | H01R 13/6585 439/660 |
| 8,708,580 | B2 * | 4/2014 | Wu | G02B 6/3817 385/147 |
| 8,814,599 | B2 * | 8/2014 | Wu | H01R 13/5808 439/607.48 |
| 9,281,626 | B2 * | 3/2016 | Lin | H01R 13/6581 |
| 9,397,433 | B2 * | 7/2016 | Kao | H01R 13/658 |
| 9,425,565 | B1 * | 8/2016 | Chien | H01R 12/707 |
| 9,728,885 | B2 * | 8/2017 | Yokoyama | H01R 13/42 |

FOREIGN PATENT DOCUMENTS

| | | | |
|---|---|---|---|
| CN | 205335539 | U | 6/2016 |
| CN | 205565062 | U | 9/2016 |

* cited by examiner

PLUG CONNECTOR WITH LOCKING AND GROUNDING STRUCTURES

CROSS-REFERENCE TO RELATED APPLICATIONS

This non-provisional application claims priority to and benefit of, under 35 U.S.C. § 119(a), Patent Application No. 201621258169.8 filed in P. R. China on Nov. 23, 2016, the entire content of which is hereby incorporated by reference.

FIELD OF THE INVENTION

The present invention relates to a plug connector, and more particularly to a plug connector having grounding and locking functions.

BACKGROUND OF THE INVENTION

A known plug connector includes an insulating body, multiple terminals arranged on the insulating body, two elastic clamp hooks arranged on two sides of the insulating body, and a metal shell sheathed outside the insulating body. A mating slot is formed by backward recessing in a front end surface of the insulating body and used for allowing a tongue of a socket connector to be inserted therein. The insulating body has a top plate located above the mating slot, a bottom plate located below the mating slot, and two side plates located on two sides of the mating slot. The terminals have multiple contacting portions arranged on the top plate and the bottom plate in a row, respectively. The two elastic clamp hooks are of a separate structure formed by blanking a sheet metal. The two elastic clamp hooks are assembled and fixed to two sides of the insulating body, and each elastic clamp hook has a locking portion protruding and extending from the corresponding side plate to the inside of the mating slot, the locking portion being used for engaging with a buckling slot in the tongue. Some of the terminals are of a tuning fork type structure formed by blanking, each of these terminals has a fixing portion and two contacting arms formed by extending forward from the fixing portion and arranged oppositely up and down, a contacting portion being formed on each contacting arm. Two outermost terminals are ground terminals. Before the tongue of the socket connector is inserted into the mating slot, a clearance is provided between each elastic clamp hook and the ground terminal on the corresponding side, and when the tongue of the socket connector is inserted into the mating slot, the tongue exerts a force on the locking portion to make a front end of the elastic clamp hook deform outward and make a rear end of the elastic clamp hook come into contact with the ground terminal, thus making the two portions grounded.

In the foregoing structured plug connector, the elastic clamp hooks are of a blanking structure, the positive forces thereof are larger, but the locking portion deforms to make the rear ends of the elastic clamp hooks deflect very slightly, and limits are made, such that electrical contact between the elastic clamp hooks and the ground terminals is unstable, and a good ground path cannot be kept at any time.

Therefore, a heretofore unaddressed need exists in the art to address the aforementioned deficiencies and inadequacies.

SUMMARY OF THE INVENTION

In one aspect, the present invention relates to a plug connector having a locking function and forming a good ground path between a latch member and a ground terminal.

In certain embodiments, a plug connector includes an insulating body, at least one ground terminal, and a latch member. A mating portion is provided in a front end of the insulating body, and a mating slot is recessed in the mating portion from front to back. One end of the ground terminal is provided with a first contacting portion protruding and extending into the mating slot, and the other end of the ground terminal is provided with a first tail portion. The latch member has a connecting portion and two locking arms located on two sides of the connecting portion and electrically connected to the connecting portion. The first tail portion is in contact with the connecting portion in an up-down direction to form electrical connection. The two locking arms are located on two sides of the mating portion and separately having a locking portion protruding and extending into the mating slot. The locking portions are used for engaging with a buckling slot of a tongue of a mating connector.

In certain embodiments, a plate surface of the first tail portion is arranged vertically, the first tail portion has an opening, and the connecting portion is located at the opening and is in contact with the first tail portion.

In certain embodiments, the opening is formed by recessing forward from a rear edge of the first tail portion, a clamping arm is formed at the first tail portion and located at each of the upper and lower sides of the opening, and the clamping arms urge against the connecting portion.

In certain embodiments, the clamping arms elastically urge against the connecting portion.

In certain embodiments, a protrusion protrudes from each clamping arm to the inside of the opening and urges against the connecting portion.

In certain embodiments, the opening is formed by recessing forward from the rear edge of the first tail portion and penetration through an upper edge or lower edge of the first tail portion.

In certain embodiments, the first tail portion elastically urges against the connecting portion.

In certain embodiments, the ground terminal is formed by blanking a sheet metal. The ground terminal has a fixing portion connected to a front end of the first tail portion. A plate surface of the fixing portion is arranged vertically. The insulating body is provided with at least one terminal slot. The fixing portion is retained in the terminal slot, and the first tail portion is suspended in the terminal slot.

In certain embodiments, there are two ground terminals arranged on the insulating body in a bilaterally symmetrical manner. Each ground terminal is of a tuning fork type terminal structure, and the two ground terminals are electrically connected at the first tail portion via a bridging portion.

In certain embodiments, a stab and a boss are arranged adjacently on at least one of the upper and lower sides of the fixing portion, and the stab and the boss are in interference fit with the terminal slot, separately.

In certain embodiments, a first soldering portion extends from the connecting portion, is exposed at the rear end of the insulating body, and is configured to be soldered with a ground wire.

In certain embodiments, the locking arms and the first soldering portion are located in the same plane.

In certain embodiments, a conducting portion extends from the first tail portion, the conducting portion is located on one side of the first soldering portion in the up-down direction, and the conducting portion, the first soldering portion and the ground wire are soldered.

In certain embodiments, a limiting block is arranged at a rear end of the insulating body, and the limiting block is located on the outer side of the conducting portion and used for limiting the conducting portion from outward deflection.

In certain embodiments, the plug connector also includes at least one power terminal and a detection terminal. The power terminal has a second soldering portion exposed at the rear end of the insulating body, the detection terminal has a third soldering portion exposed at the rear end of the insulating body, and the first, second and third soldering portions are located in planes at heights at different heights in the up-down direction.

In certain embodiments, the latch member is provided with a material connecting portion at the connecting portion, and the material connecting portion and the first soldering portion are connected to different positions at a rear end of the connecting portion.

In certain embodiments, the plug connector further includes two power terminals arranged in a bilaterally symmetrical manner. The two power terminals are electrically connected via a crossbeam portion. The crossbeam portion is located in front of the connecting portion, and a second soldering portion is formed by extending backwards from the crossbeam portion and across the connecting portion.

In certain embodiments, the plug connector further includes two power terminals arranged in a bilaterally symmetrical manner. The two power terminals are electrically connected via a crossbeam portion. The crossbeam portion is located behind the connecting portion, and a second soldering portion is formed by extending outwards from one side of the crossbeam portion. The second soldering portion is formed by extending in a left-right direction.

In certain embodiments, the plug connector also includes a metal shell sheathed outside the insulating body. An open slot is provided in each of two sides of the mating portion and accommodates the corresponding locking arm. Protruding ribs protrude from an outer surface of the mating portion, are located above and below the open slots, and are in interference fit with the metal shell.

In another aspect, the present invention relates to a plug connector. In certain embodiments, a plug connector includes an insulating body, two ground terminals disposed in the insulating body, and a latch member. A mating portion is provided in a front end of the insulating body, and a mating slot is recessed in the mating portion from front to back. One end of each ground terminal is provided with a first contacting portion protruding and extending into the mating slot, and the other end of each ground terminal is provided with a first tail portion. The latch member has two locking arms located on two sides of the mating portion. Each locking arm has a locking portion protruding and extending into the mating slot. The locking portions are used for engaging with buckling slots in the corresponding sides of a tongue of a mating socket connector. The first tail portion is in contact with the locking arm on the corresponding side in an up-down direction to form electrical connection. A plate surface of the first tail portion is perpendicular to plate surface of the corresponding locking arm.

In certain embodiments, the plate surfaces of the first tail portions are arranged vertically, each of the first tail portions has an opening, the two locking arms extend toward each other to form positioning protrusion portions, the positioning protrusion portions are located at rear ends of the locking arms, and the positioning protrusion portions are located at the openings and are in contact with the first tail portions.

In certain embodiments, the opening is formed by recessing forward from a rear edge of the first tail portion, a clamping arm is formed at the first tail portion and located at each of the upper and lower sides of the opening, and the clamping arms urge against the positioning protrusion portions.

In certain embodiments, the clamping arms elastically urge against the positioning protrusion portions.

In certain embodiments, a protrusion protrudes from each clamping arm to the inside of the opening and urges against the corresponding positioning protrusion portion.

In certain embodiments, the opening is formed by recessing forward from the rear edge of the first tail portion and penetration through an upper edge or lower edge of the first tail portion.

In certain embodiments, the first tail portion elastically urges against the positioning protrusion portions.

In certain embodiments, the ground terminal is formed by blanking a sheet metal, the ground terminal has a fixing portion connected to a front end of the first tail portion, a plate surface of the fixing portion is arranged vertically, the insulating body is provided with at least one terminal slot, the fixing portion is retained in the terminal slot, and the first tail portion is suspended in the terminal slot.

In certain embodiments, each ground terminal is of a tuning fork type terminal structure, the two ground terminals are arranged on the insulating body in a bilaterally symmetrical manner, and the two ground terminals are electrically connected at the first tail portion via a bridging portion.

In certain embodiments, a stab and a boss are arranged adjacently on at least one of the upper and lower sides of the fixing portion, and the stab and the boss are in interference fit with the terminal slot, separately.

In certain embodiments, a connecting portion is connected between the two locking arms, and a first soldering portion extends from the connecting portion, is exposed at the rear end of the insulating body, and is configured to be electrically connected to a ground wire of a cable.

In certain embodiments, the plug connector also includes a detection terminal and two power terminals arranged symmetrically and connected electrically. The two power terminals have a second soldering portion exposed at the rear end of the insulating body, the detection terminal has a third soldering portion exposed at the rear end of the insulating body, and the first, second and third soldering portions are located in planes at different heights in the up-down direction.

In certain embodiments, the plug connector further includes two power terminals arranged in a bilaterally symmetrical manner. The two power terminals are electrically connected via a crossbeam portion, a connecting portion is electrically connected between the two locking arms, the crossbeam portion is located in front of the connecting portion, and a second soldering portion is formed by extending backwards from the crossbeam portion and across the connecting portion.

In certain embodiments, the plug connector also includes a metal shell sheathed outside the insulating body. An open slot is provided in each of two sides of the mating portion and accommodates the corresponding locking arm, and protruding ribs protrude from an outer surface of the mating portion, are located above and below the open slots, and are in interference fit with the metal shell.

Compared with the related art, certain embodiments of the present invention have the advantages that a good ground path between the ground terminal and the latch member may be kept by means of contact between the first tail portion and the connecting portion of the latch member or the locking arms of the latch member in the up-down direction to form electrical connection, and the latch member is provided with the locking portions protruding and extending into the mating slot to engage with the buckling slots of the tongue. Therefore, the plug connector not only has a locking function, but also forms the good ground path between the latch member and the ground terminal at the same time.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
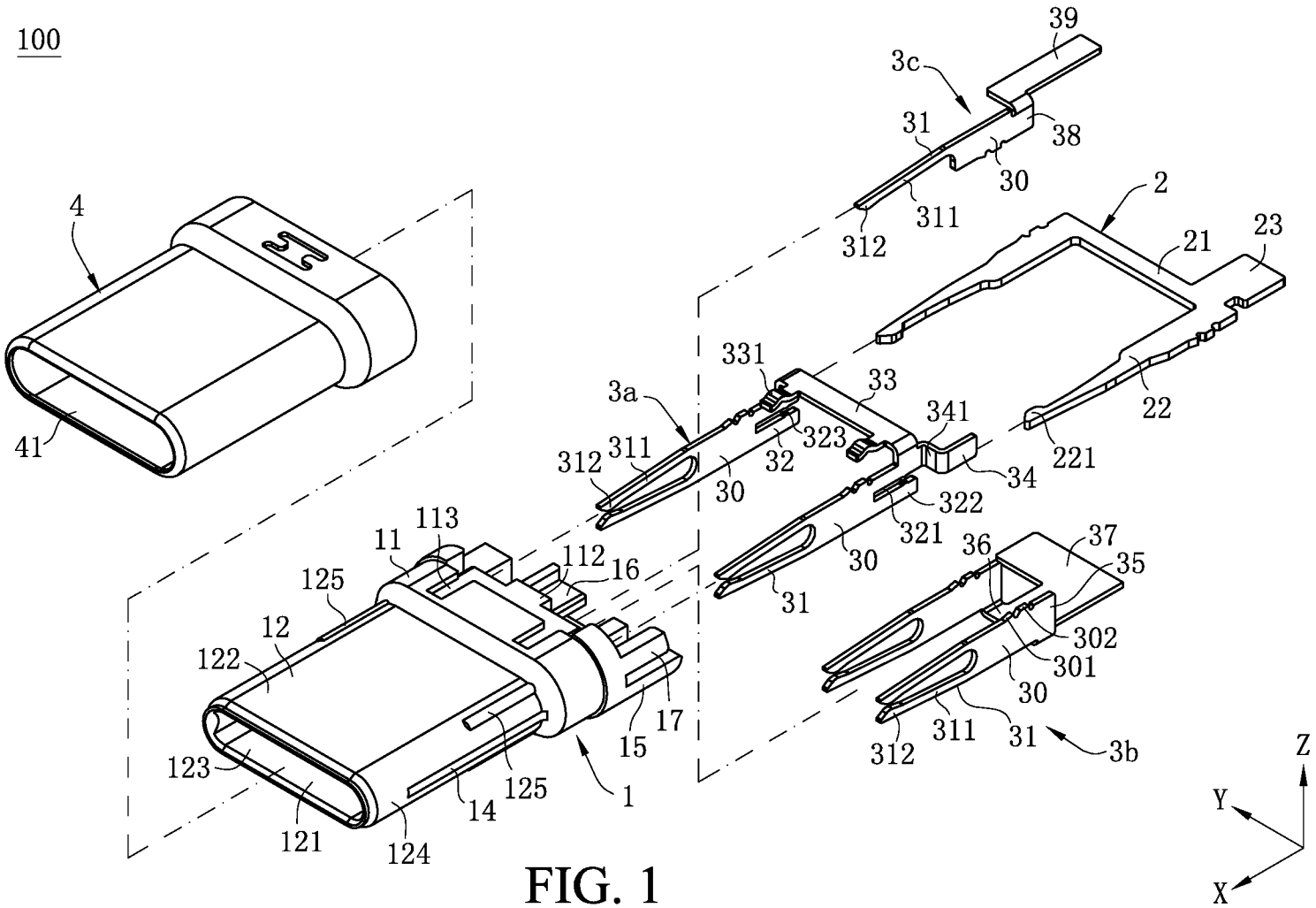
FIG. 1 is a schematic three-dimensional exploded view of a first embodiment of a plug connector according to the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-15. In accordance with the purposes of this invention, as embodied and broadly described herein, this invention, in one aspect, relates to a plug connector.

Figure 4:
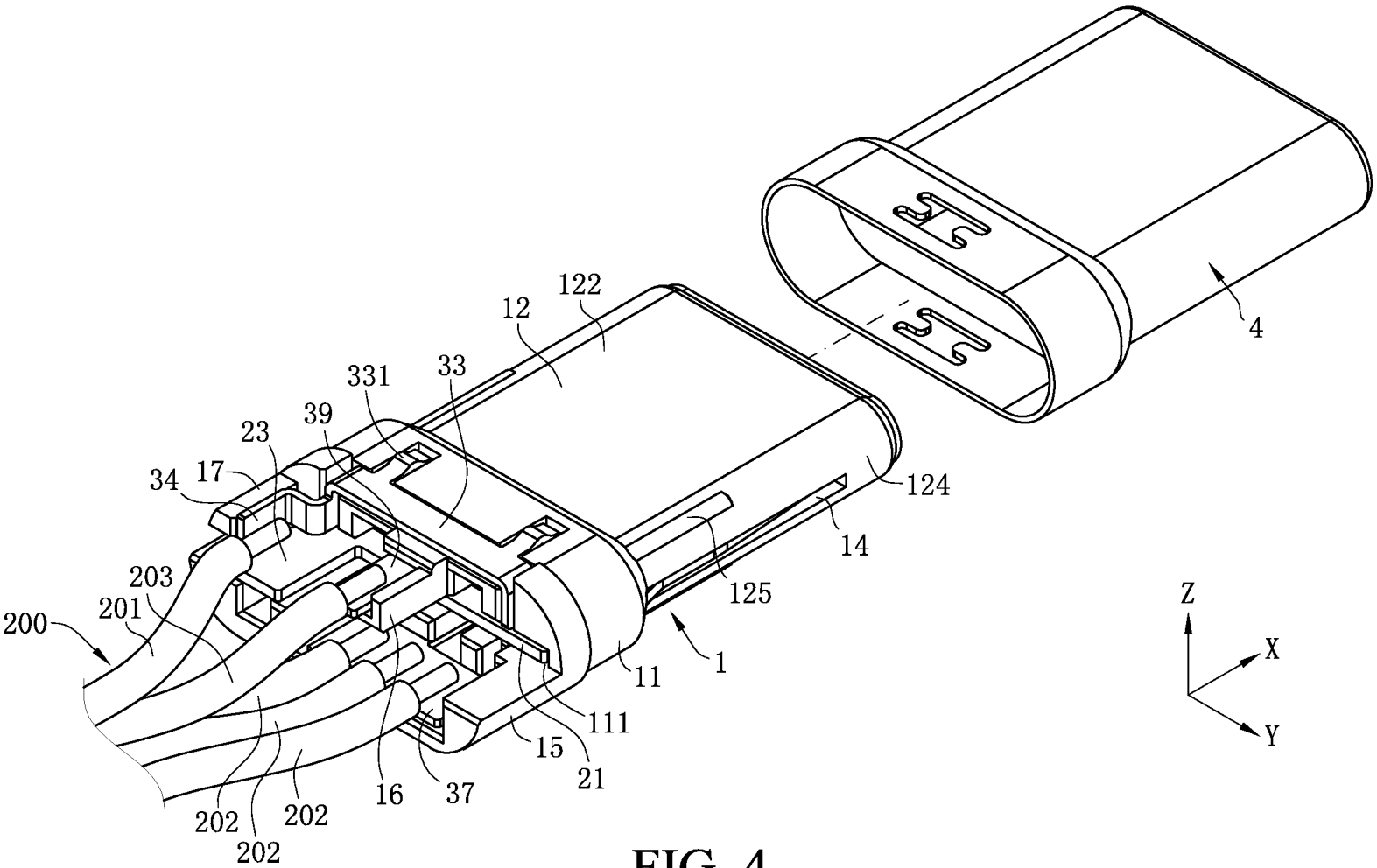
FIG. 4 is a schematic three-dimensional view of a terminal and a latch member assembled to an insulating body and soldered with a cable in FIG. 3A.

Referring to FIG. 1 and FIG. 4, a plug connector 100 of a first embodiment of the present invention includes an insulating body 1, a latch member 2 arranged on the insulating body 1, multiple terminals 3 arranged on the insulating body 1, and a metal shell 4 sheathed outside the insulating body 1. The plug connector 100 is used for being connected to a cable 200. For convenience of understanding, the accompanying drawings of the present invention adopt a three-dimensional coordinate system, where X represents forward direction, Y represents rightward direction, and Z represents upward direction.

Referring to FIG. 1 and FIG. 3, the insulating body 1 has a base 11 and a mating portion 12 extending forward from the base 11. A clamping slot 111 is formed in a rear end surface of the base 11 in a recessed manner from back to front. The clamping slot 111 is located in the middle of the base 11 in an up-down direction. A recessed portion 112 and two receiving slots 113 are formed in an outer surface of the upper side of the base 11 in an inwardly recessed manner. The recessed portion 112 penetrates backward through the rear end surface of the base 11, the two receiving slots 113 are located on two sides in front of the recessed portion 112, and the receiving slots 113 are communicated with the recessed portion 112 and extend in a front-back direction.

Figure 15:
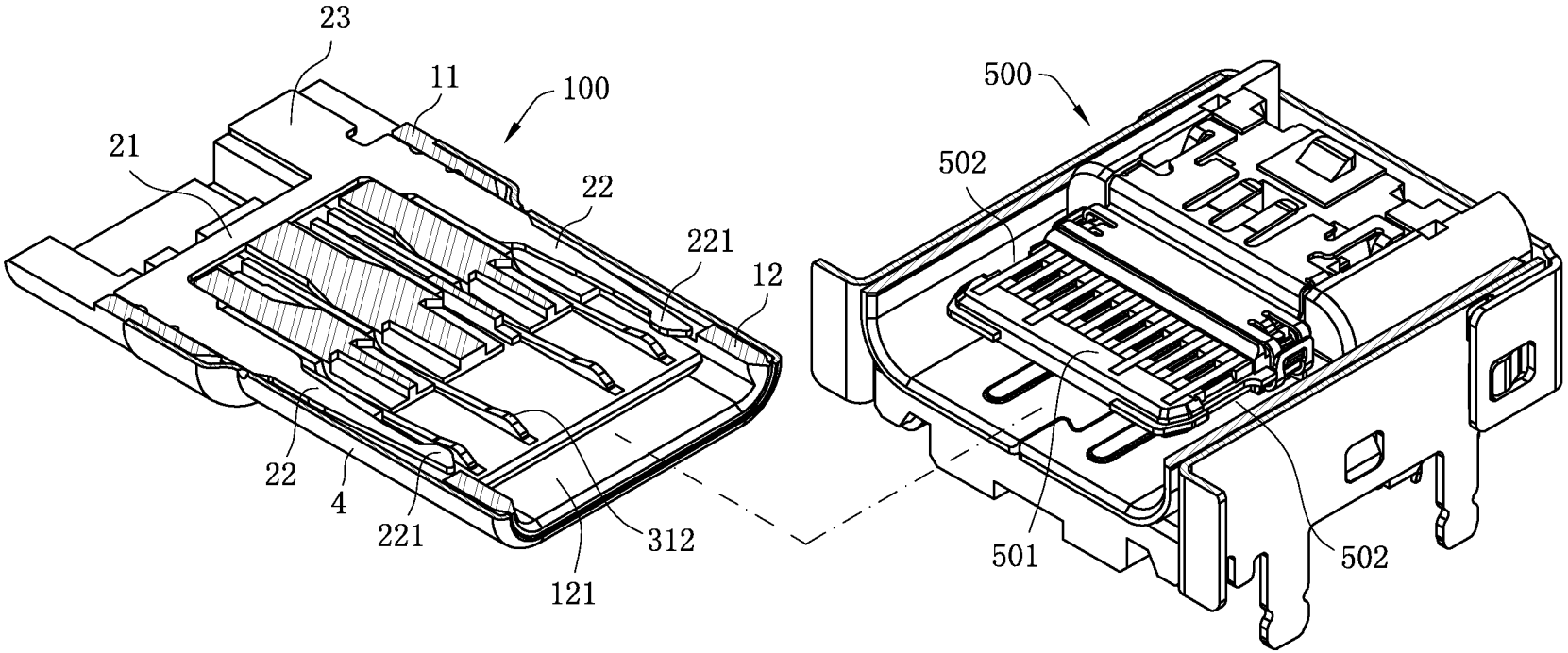
FIG. 15 is a three-dimensional section view of a plug connector and a mating socket connector according to certain embodiment of the present invention.

Referring to FIG. 1 and FIG. 15, the mating portion 12 has a front end surface (not shown), a mating slot 121 formed by backward recessing from the front end surface, a top plate 122 located above the mating slot 121, a bottom plate 123 located below the mating slot 121, and two side plates 124 located on two sides of the mating slot 121. A tongue 501 of a socket connector 500 may be inserted into the mating slot 121 forwardly in dual orientation.

Figure 3A:
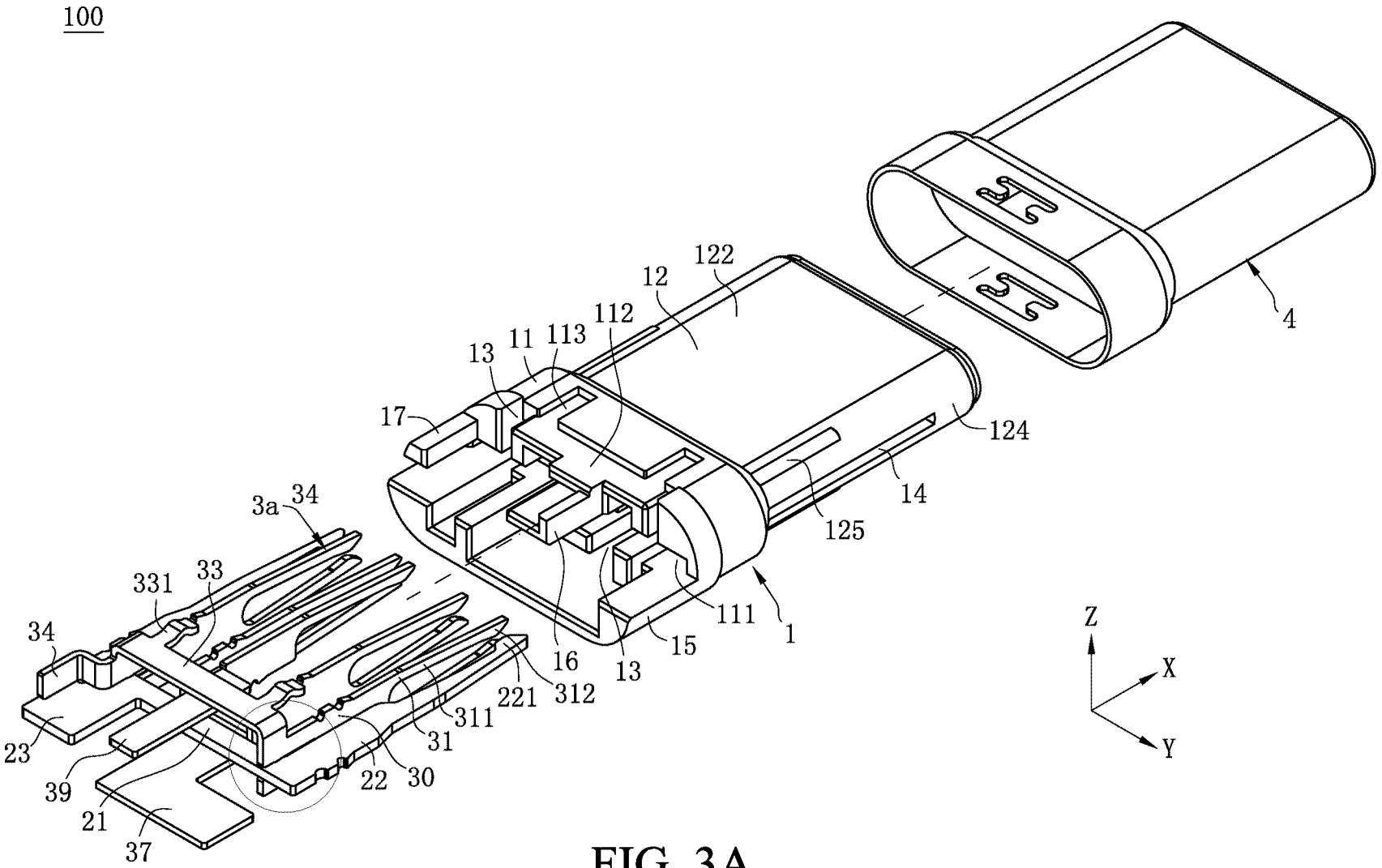
FIG. 3A is a schematic three-dimensional exploded view of the first embodiment of the plug connector of the present invention viewed from another view angle.
Figure 3B:
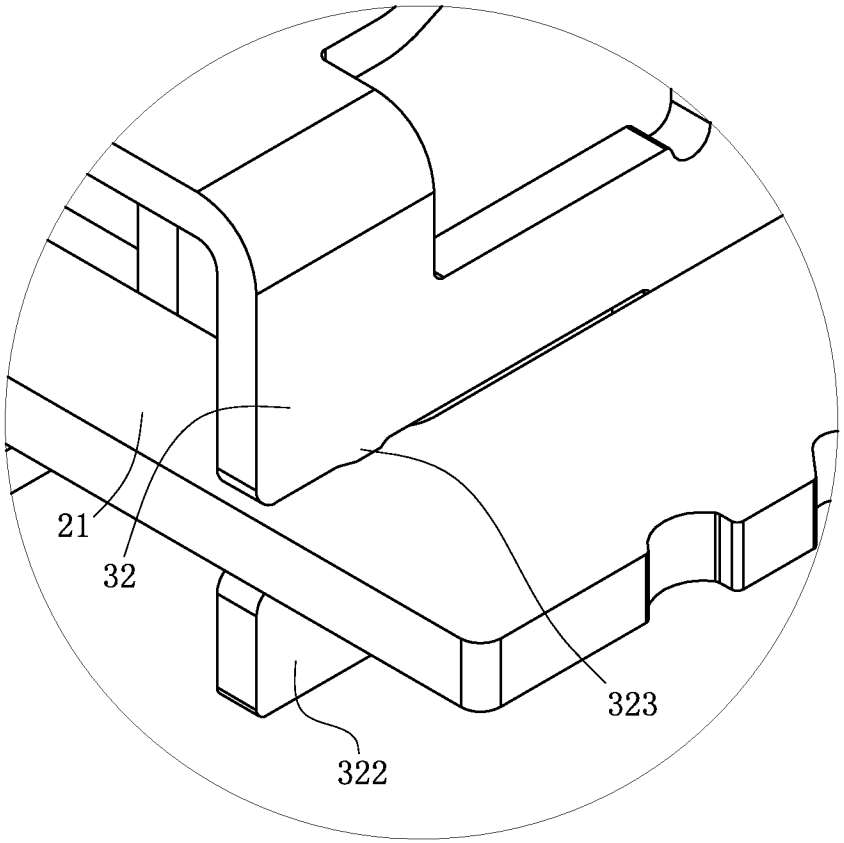
FIG. 3B a local enlarged view of the plug connector in FIG. 3A.

Referring to FIG. 1, FIG. 3A and FIG. 3B, the insulating body 1 has multiple terminal slots 13 and two open slots 14. The multiple terminal slots 13 extend from the base 11 to the top plate 122 and the bottom plate 123. The two open slots 14 are located on two sides of the insulating body 1. The open slots 14 extend from the base 11 to the side plates 124, and the open slots 14 are in communication with the mating slot 121 and the clamping slot 111 respectively. Protruding ribs 125 protrude from an outer surface of the mating portion 12 and are located above and below the open slots 14.

Referring to FIG. 3A and FIG. 3B, the insulating body 1 is further provided with a soldering plate 15 formed by extending backward from the lower side of a rear end of the base 11, and a supporting plate 16 and a limiting block 17 extending backward from the rear end of the base 11 and located above the soldering plate 15. The supporting plate 16 is substantially located at a middle position of the insulating body 1 in a left-right direction and substantially located on the lower side of the insulating body 1 in the up-down direction, and the limiting block 17 is substantially located at a position close to one side of the insulating body 1 in the left-right direction.

Figure 2:
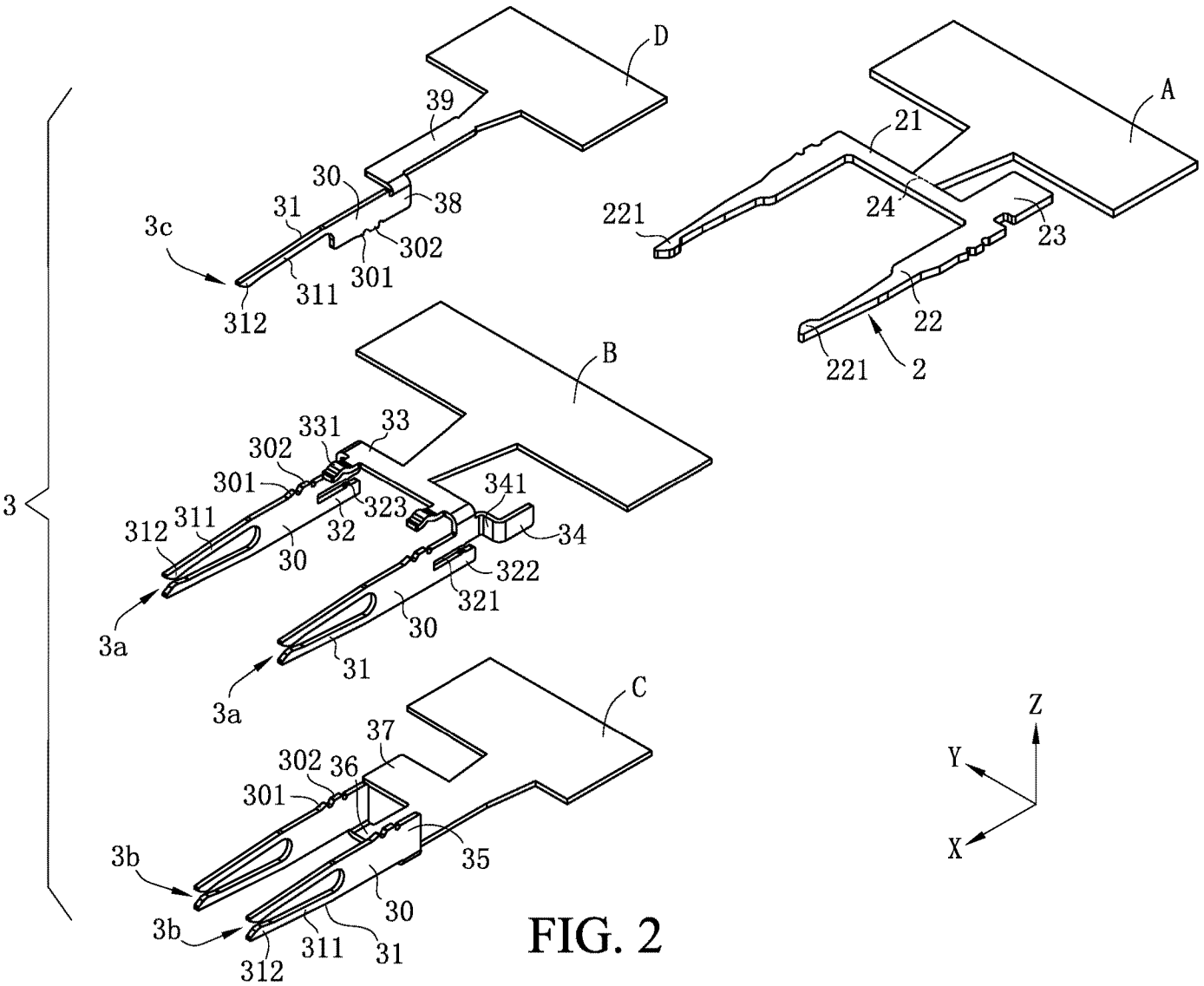
FIG. 2 is a schematic three-dimensional exploded view of a terminal and a latch member not separated from each strip in FIG. 1.

Referring to FIGS. 1, 2 and 4, the latch member 2 has a connecting portion 21 and two locking arms 22 located on two sides of the connecting portion 21 and electrically connected to the connecting portion 21. In the present embodiment, the latch member 2 is formed by blanking a sheet metal. That is, the connecting portion 21 and the locking arms 22 are integrally formed and located in the same horizontal plane. The connecting portion 21 extends in the left-right direction. The connecting portion 21 is retained in the clamping slot 111, each locking arm 22 is arranged in the corresponding open slot 14 and has a locking portion 221 protruding and extending into the mating slot 121, and the locking portions 221 are used for engaging with a buckling slot 502 of the tongue 501 of the mating socket connector. The latch member 2 is provided with a first soldering portion 23 and a material connecting portion 24 arranged behind the connecting portion 21. The first soldering portion 23 is close to one side of the connecting portion 21, and is supported and connected above the soldering plate 15. Moreover, the locking arms 22 and the first soldering portion 23 are located in the same plane, and the material connecting portion 24 is connected to a strip A at the middle position of the connecting portion 21 in the left-right direction.

Referring to FIG. 2, the multiple terminals 3 are correspondingly received in the terminal slots 13. The terminals 3 include multiple ground terminals 3*a*, multiple power terminals 3*b* and a detection terminal 3*c*. The terminals 3 are formed by blanking sheet metals. In the present embodiment, the plug connector 100 is of a simple universal serial bus (USB) Type-C structure. There are two ground terminals 3*a*, two power terminals 3*b* and one detection terminal 3*c*. The ground terminals 3*a* and the power terminals 3*b* are both tuning fork type structure terminals, and the two ground terminals 3*a* and the two power terminals 3*b* are arranged on the insulating body 1 in a bilaterally symmetrical manner.

Referring to FIG. 2 and FIG. 4, each terminal 3 has a fixing portion 30 fixed to the corresponding terminal slot 13. A plate surface of the fixing portion 30 is arranged vertically. A stab 301 and a boss 302 are arranged adjacently on at least one of the upper and lower sides of each of the fixing portions 30. The stab 301 and the boss 302 are in interference fit with the terminal slot 13, respectively. The stab 301 is located in front of the boss 302. The stab 301 is in a spine shape, and the boss 302 is in an irregular trapezoid shape. An extending portion 31 extends from the front of each of the fixing portions 30, and a plate surface of the extending portion 31 is arranged vertically likewise. The extending portion 31 of each of the ground terminals 3*a* and the power terminals 3*b* has two contacting arms 311 arranged oppositely up and down. The two contacting arms 311 are respectively located on the top plate 122 and the bottom plate 123. A contacting portion 312 is formed by protrusion and extension of each contacting arm 311 to the mating slot 121. The contacting portions 312 of the two contacting arms 311 are aligned up and down. The extending portion 31 of the detection terminal 3*c* only has one contacting arm 311 arranged on the top plate 122 or the bottom plate 123.

Figure 5A:
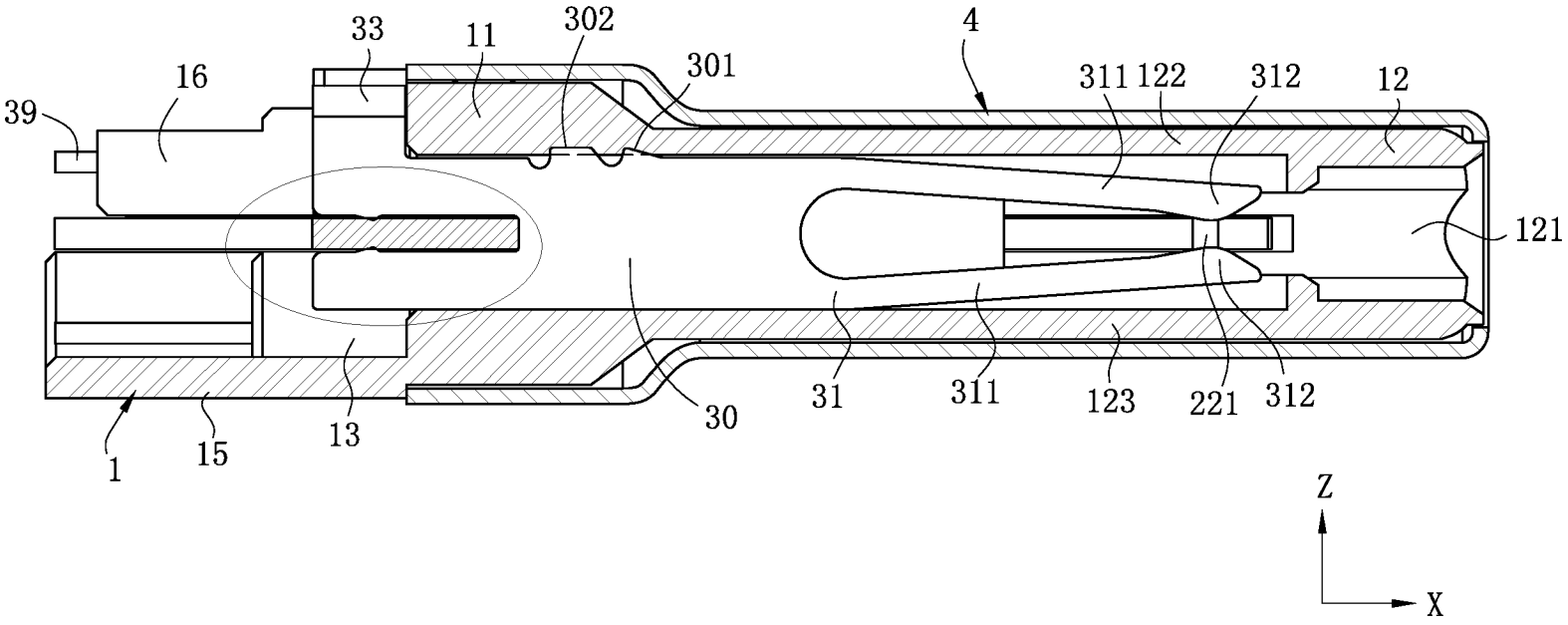
FIG. 5A is a section view of a combined plug connector in FIG. 3A.
Figure 5B:
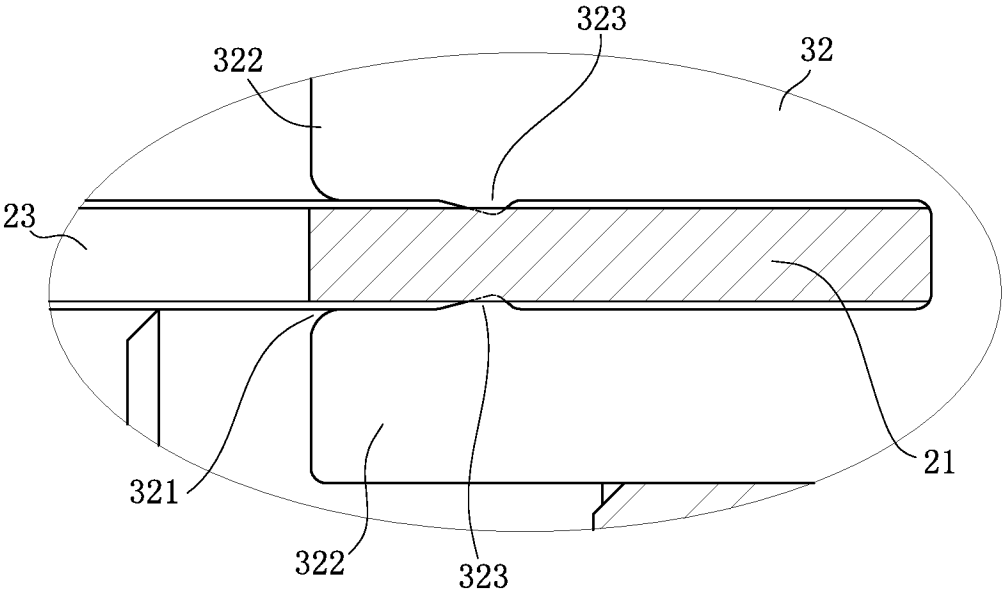
FIG. 5B a local enlarged view of the plug connector in FIG. 5A.
Figure 6A:
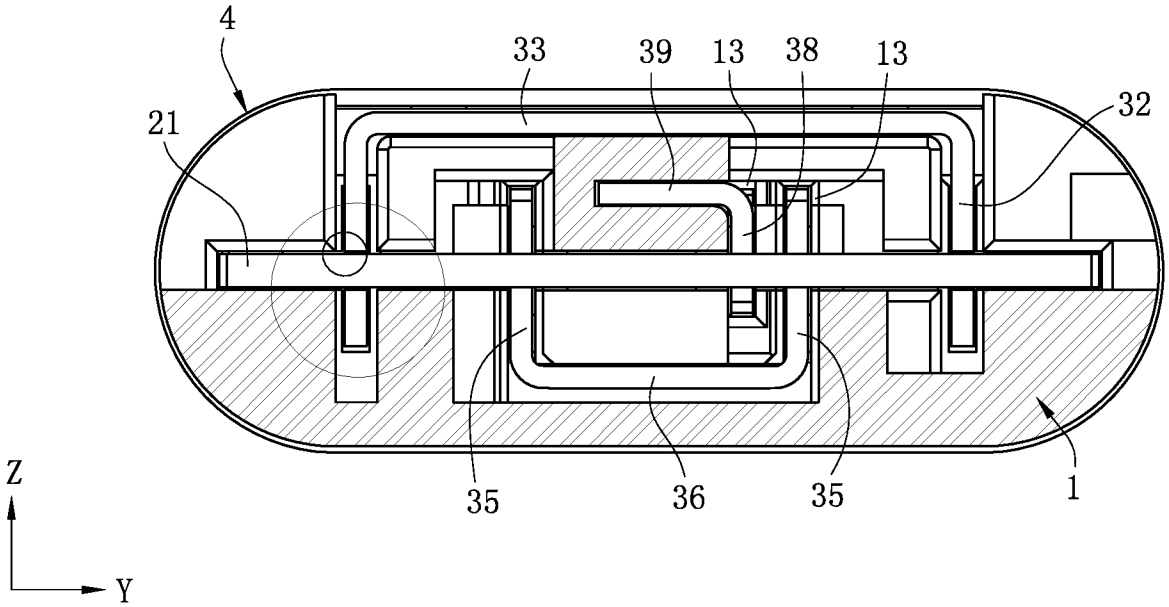
FIG. 6A is another section view of a combined plug connector in FIG. 3A.
Figure 6B:
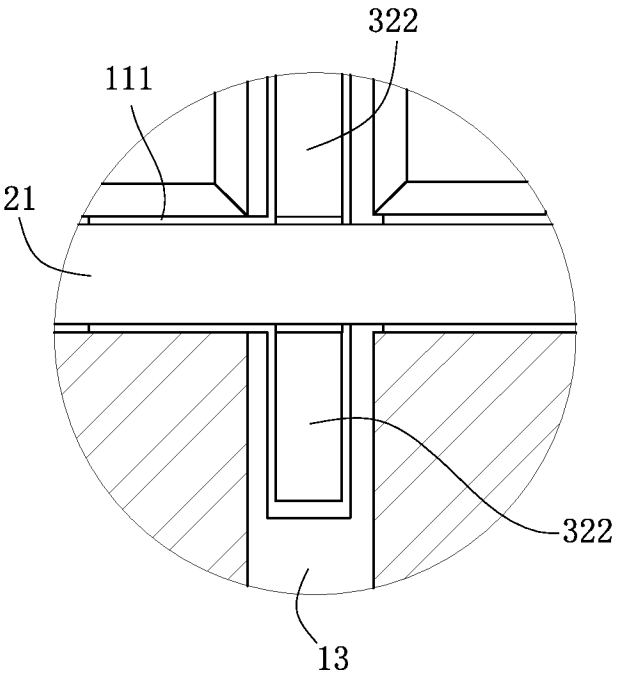
FIG. 6B a local enlarged view of the plug connector in FIG. 6A.

Referring to FIG. 1, FIG. 2, FIG. 5A and FIG. 5B, each ground terminal 3*a* has a first tail portion 32 extending backward from the fixing portion 30 thereof, and a plate surface of the first tail portion 32 is arranged vertically, such that a plate surface of the first tail portion 32 is perpendicular to a plate surface of the latch member 2. The first tail portion 32 is suspended in the corresponding terminal slot 13. That is, a clearance is provided between the first tail portion 32 and the periphery of the terminal slot 13. The first tail portion 32 has an opening 321, the opening 321 is formed by recessing forward from a rear edge of the first tail portion 32, and a clamping arm 322 is formed at the first tail portion 32 and located at each of the upper and lower sides of the opening 321. The clamping arms 322 are elastic, and a protrusion 323 protrudes from each clamping arm 322 to the inside of the opening 321. The connecting portion 21 is located at the opening 321, and the clamping arms 322 elastically urge against the connecting portion 21 in the up-down direction, such that the protrusions 323 are in tight contact with the connecting portion 21 (as shown in FIG. 3B, FIG. 5B and FIG. 6B), thus keeping good ground paths between the two ground terminals 3*a* and the latch member 2. The two ground terminals 3*a* are electrically connected at the first tail portions 32 via a bridging portion 33. The bridging portion 33 is arranged in the recessed portion 112. Two ground elastic sheets 331 integrally extend forwards from a front end of the bridging portion 33. The two ground elastic sheets 331 are correspondingly accommodated in the two receiving slots 113. The ground elastic sheets 331 protrude out of an outer surface of the base 11 to be in contact with the metal shell 4 so as to be grounded. A strip B is connected to a substantially middle position of a rear end of the bridging portion 33. The first tail portion 32 of one of the two ground terminals 3*a* is integrally connected to a conducting portion 34, and the conducting portion 34 is located on one side of the first soldering portion 23 in the up-down direction. In the present embodiment, the conducting portion 34 is connected to the upper clamping arm 322, and shifts out relative to the first tail portion 32 via a bending portion 341, such that the conducting portion 34 is relatively close to the outer side of the first soldering portion 23. The limiting block 17 is located on the outer side of the conducting portion 34 to limit the conducting portion 34 from outward deflection. In the present embodiment, the two ground terminals 3*a*, the bridging portion 33, the two ground elastic sheets 331 and the conducting portion 34 are integrally formed by a sheet metal.

Figure 7:
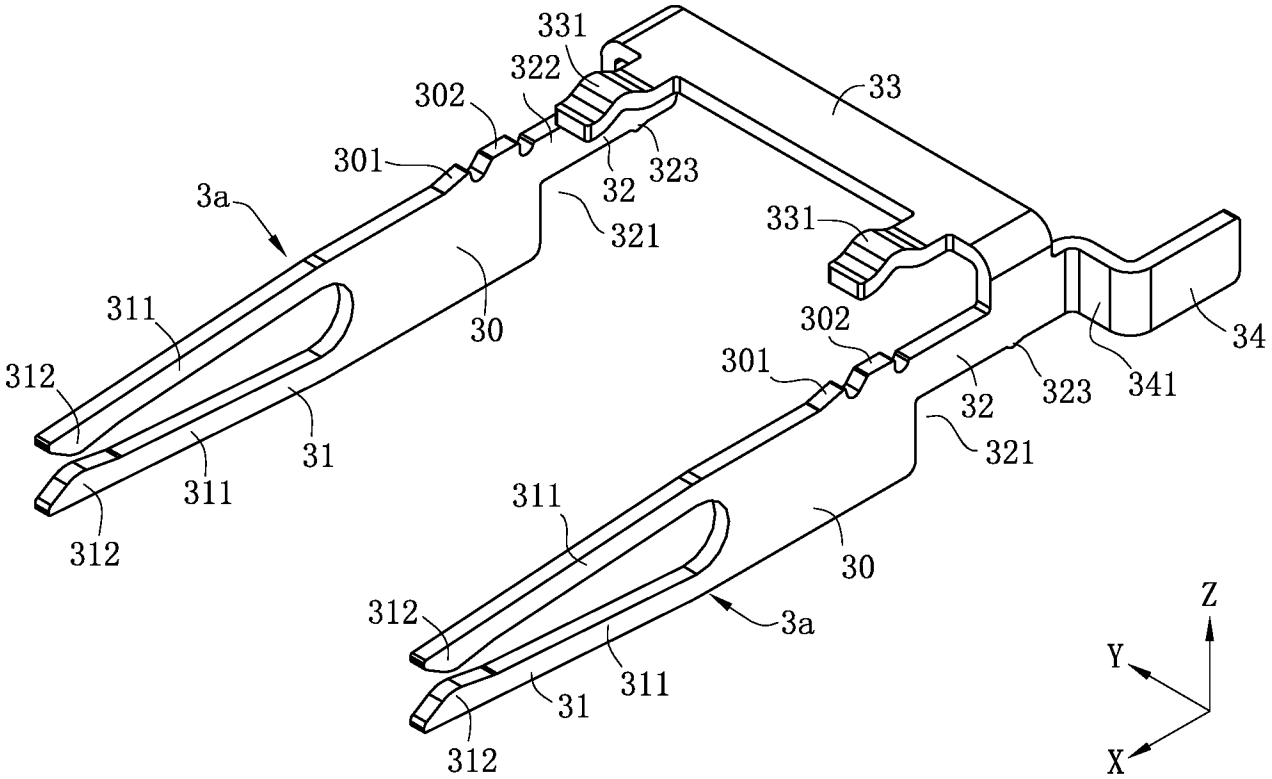
FIG. 7 is a schematic three-dimensional view of another embodiment of the present invention, where two ground terminals are arranged in a bilaterally symmetrical manner.

Referring to FIG. 2 and FIG. 7, in other embodiments, the opening 321 is formed by recessing forward from the rear edge of the first tail portion 32 and penetration through an upper edge or lower edge of the first tail portion 32. That is, the first tail portion 32 has only one clamping arm 322. This clamping arm 322 elastically urges against the connecting portion 21 in the up-down direction likewise. Good ground paths between the latch member 2 and the two ground terminals 3*a* may be kept likewise.

Referring to FIGS. 2, 5A, 5B, 6A and 6B, each power terminal 3*b* has a second tail portion 35 extending backward from the fixing portion 30 thereof, and a plate surface of the second tail portion 35 is arranged vertically likewise. The second tail portion 35 is suspended in the corresponding terminal slot 13. That is, a clearance is provided between the second tail portion 35 and the periphery of the terminal slot 13. The two power terminals 3*b* arranged in a symmetrical manner are electrically connected at the second tail portions 35 via a crossbeam portion 36. The crossbeam portion 36 is located in front of the connecting portion 21. A second soldering portion 37 is formed by extending backward from the crossbeam portion 36 and across the connecting portion 21. The second soldering portion 37 is also supported and connected above the soldering plate 15, and a strip C is connected to a rear end of the second soldering portion 37. In the present embodiment, the two power terminals 3*b*, the crossbeam portion 36 and the second soldering portion 37 are integrally formed by a sheet metal.

Referring to FIGS. 2, 4, 6A and 6B, the detection terminal 3*c* has a third tail portion 38 extending backward from the fixing portion 30 thereof, a plate surface of the third tail portion 38 is arranged vertically likewise, and the third tail portion 38 is located in front of the connecting portion 21. The third tail portion 38 is suspended in the corresponding terminal slot 13. That is, a clearance is provided between the third tail portion 38 and the periphery of the terminal slot 13. A third soldering portion 39 is formed by bending one of the upper and lower opposite sides of the third tail portion 38 and extending backward and across the connecting portion 21. The third soldering portion 39 is located on the supporting plate 16, and a strip D is connected to the rear end of the third soldering portion 39. Plate surfaces of the first soldering portion 23, the second soldering portion 37 and the third soldering portion 39 are all arranged horizontally in planes at different heights.

Referring to FIG. 1, the metal shell 4 is of a seamlessly connected tubular structure formed by a drawing and printing process, and has a receiving cavity 41. The insulating body 1 is accommodated in the receiving cavity 41, and the protruding ribs 125 are in interference fit with the metal shell 4 to make the metal shell 4 and the insulating body 1 tightly retained together.

Referring to FIG. 4, the cable 200 includes a ground wire 201, multiple power wires 202 and a detection wire 203. An inner conductor (not shown) of the ground wire 201 is arranged on the first soldering portion 23 and is close to the conducting portion 34, the three portions being soldered together using tin material (not shown), such that the three portions are grounded well. Inner conductors (not shown) of the multiple power wires 202 are arranged on the second soldering portion 37 side by side. An inner conductor (not shown) of the detection wire 203 is arranged on the third soldering portion 39 correspondingly.

Figure 8:
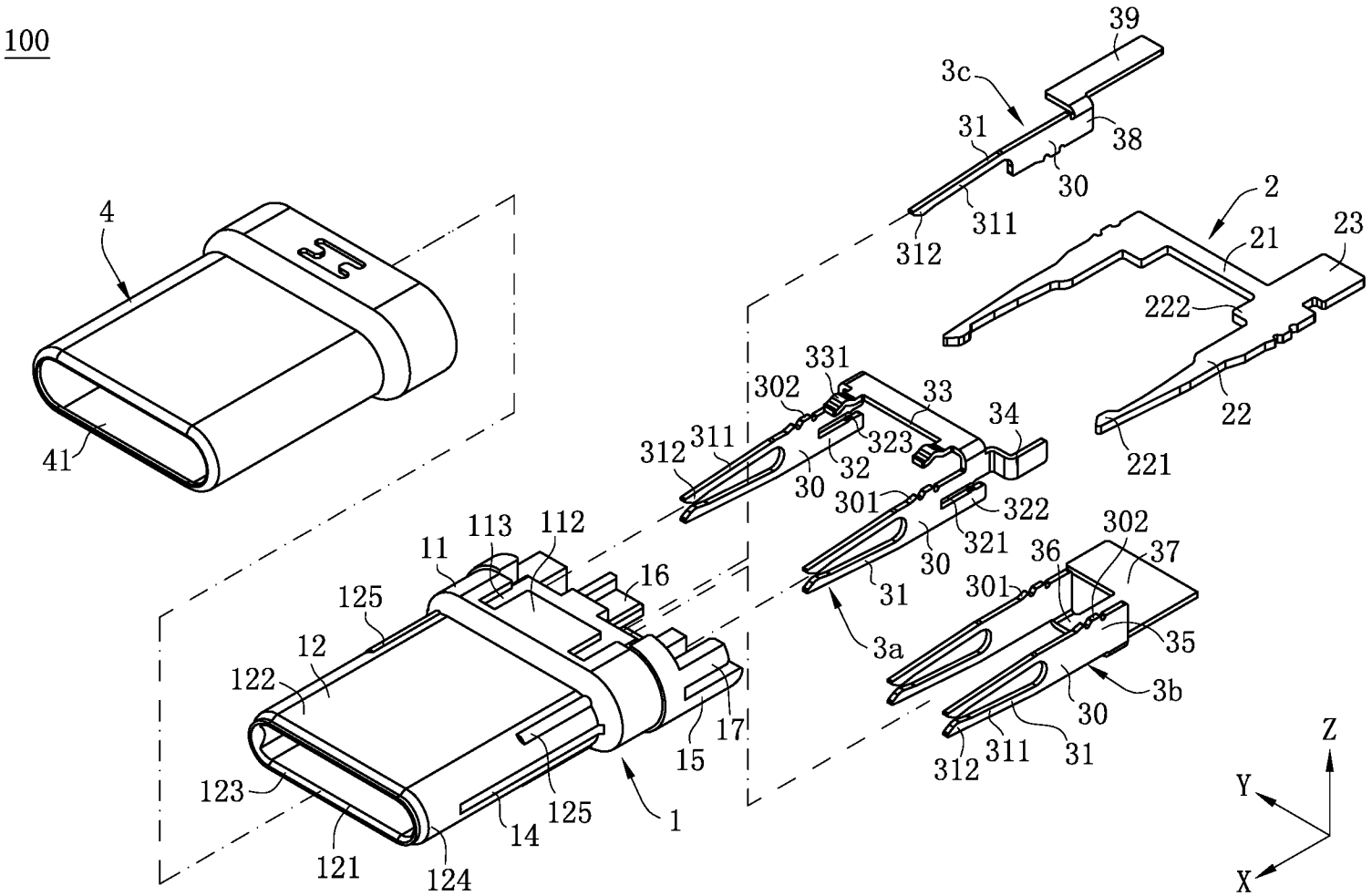
FIG. 8 is a schematic three-dimensional exploded view of a second embodiment of a plug connector according to the present invention.
Figure 9:
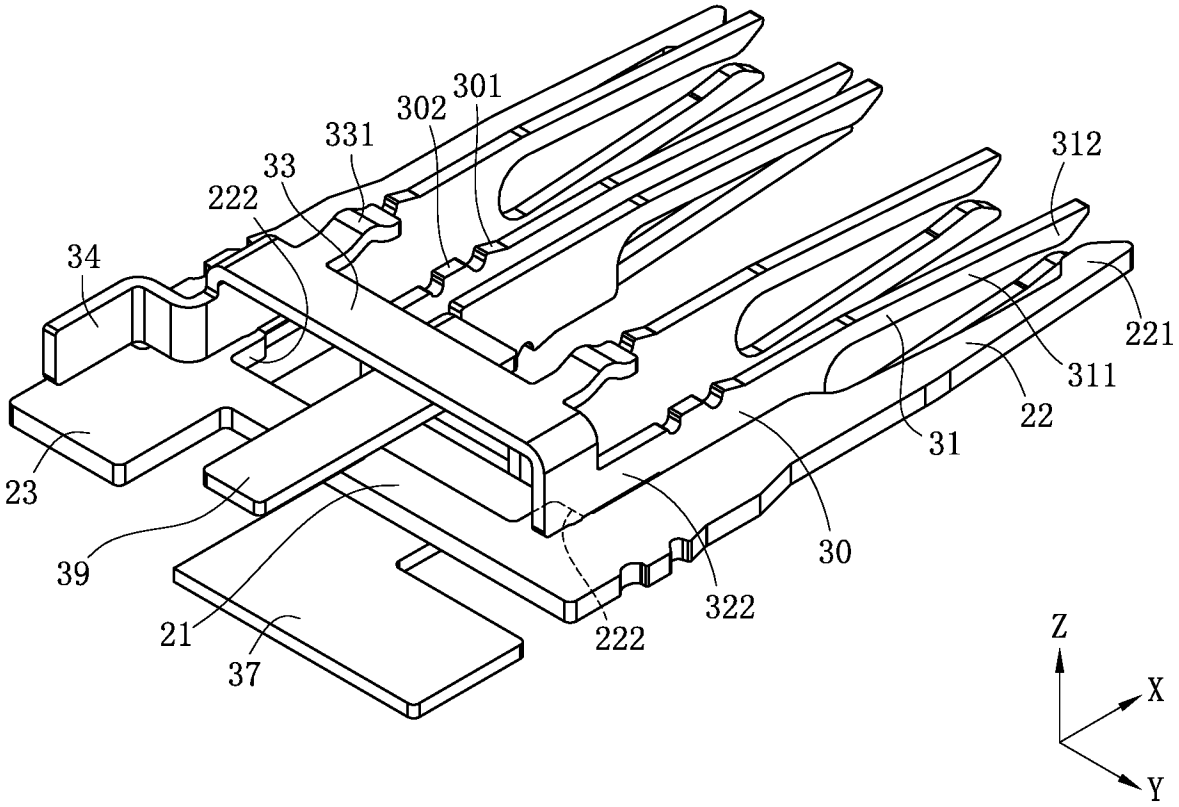
FIG. 9 is a schematic three-dimensional view of a relative position relationship between a terminal and a latch member in FIG. 8.

FIG. 8 and FIG. 9 show a plug connector 100 according to a second embodiment of the present invention. The structure of the second embodiment is basically the same as that of the foregoing first embodiment. Therefore, the same numerals in the figures represent the same structures, and the same structures will not be elaborated. The difference between the structure of the second embodiment and the structure of the foregoing first embodiment lies in that: the two locking arms 22 extend toward each other from rear ends to form positioning protrusion portions 222, and the positioning protrusion portions 222 are located in front of the connecting portion 21 and are connected to the connecting portion 21. In this case, the positioning protrusion portions 222 are located in the opening 321, the clamping arms 322 elastically urge against the positioning protrusion portions 222 in the up-down direction, such that the protrusions 323 are in tight contact with the connecting portion 21, thus maintaining good ground paths between the two ground terminals 3*a* and the latch member 2.

Referring to FIG. 8, the opening 321 may also be formed by recessing forward from the rear edge of the first tail portion 32 and penetration through an upper edge or lower edge of the first tail portion 32. That is, each of the first tail portions 32 has only one clamping arm 322. This clamping arm 322 elastically urges against the connecting portion 21 in the up-down direction likewise. Good ground paths between the latch member 2 and the two ground terminals 3*a* may be maintained likewise.

Figure 10A:
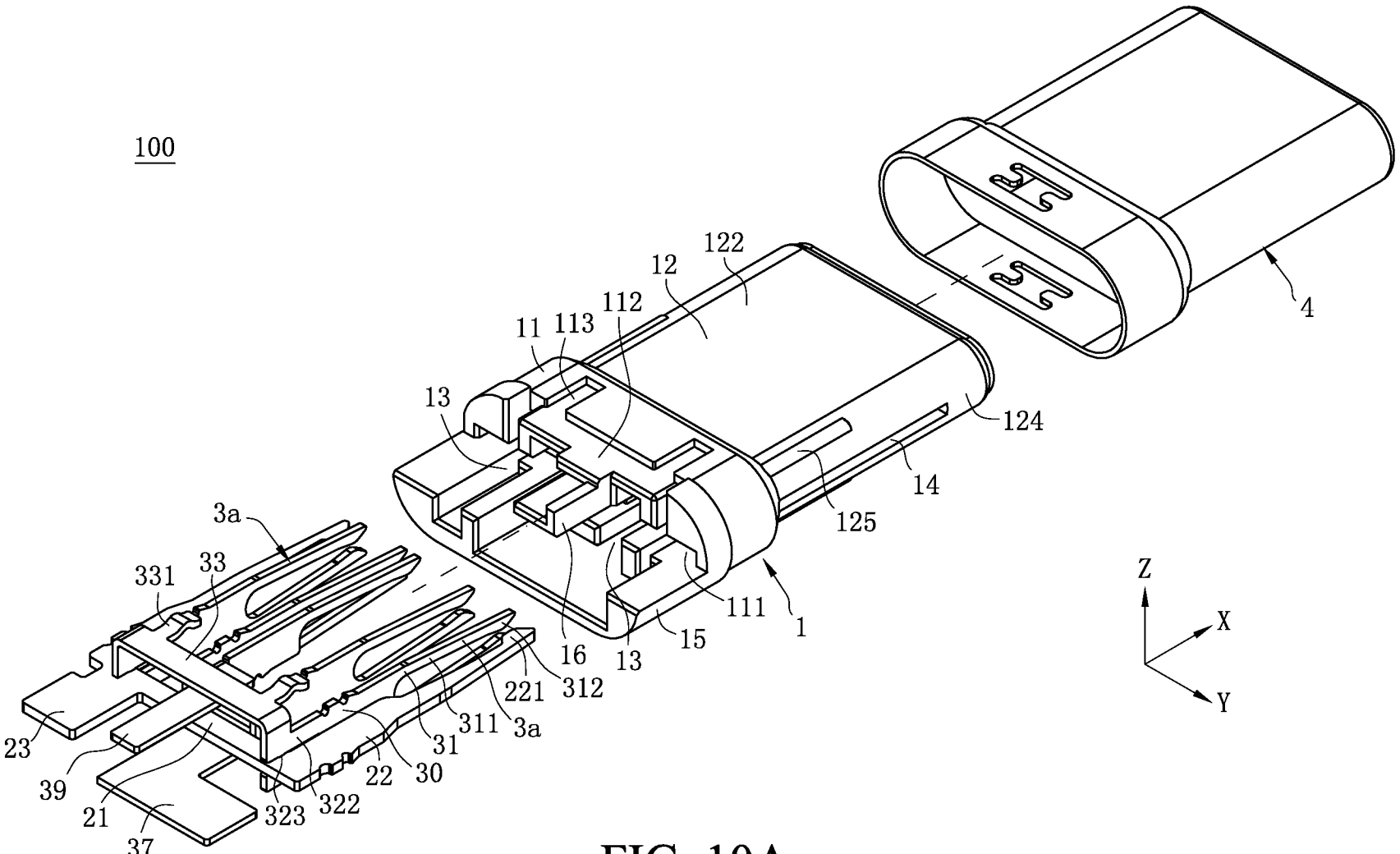
FIG. 10A is a schematic three-dimensional exploded view of a third embodiment of a plug connector according to the present invention.
Figure 10B:
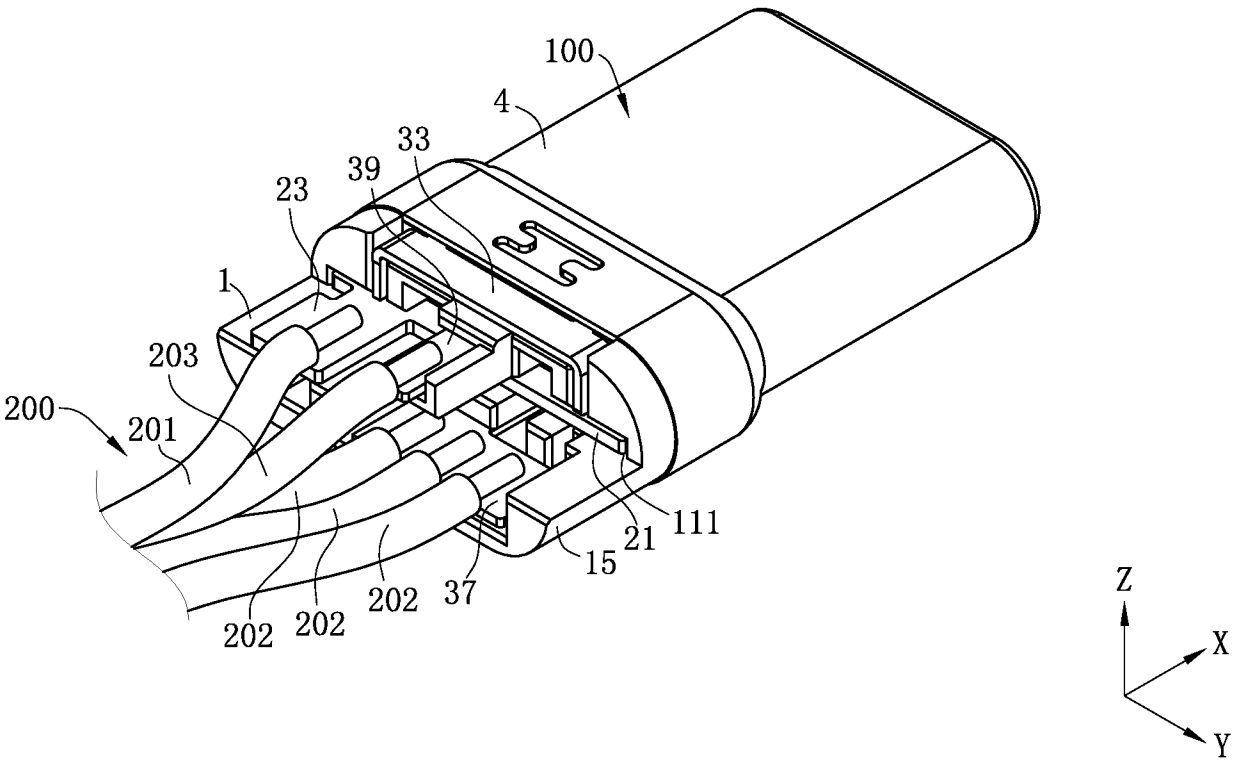
FIG. 10B is a schematic three-dimensional combined view of a plug connector connected to a cable in FIG. 10A.

FIG. 10A and FIG. 10B show a plug connector 100 according to a third embodiment of the present invention. The structure of the third embodiment is basically the same as that of the foregoing first embodiment. Therefore, the same numerals in the figures represent the same structures, and the same structures will not be elaborated. The difference between the structure of the third embodiment and the structure of the foregoing first embodiment lies in that: the ground wire 201 is soldered to the first soldering portion 23, and is electrically conducted to the two ground terminals 3*a* via the first soldering portion 23.

Figure 11:
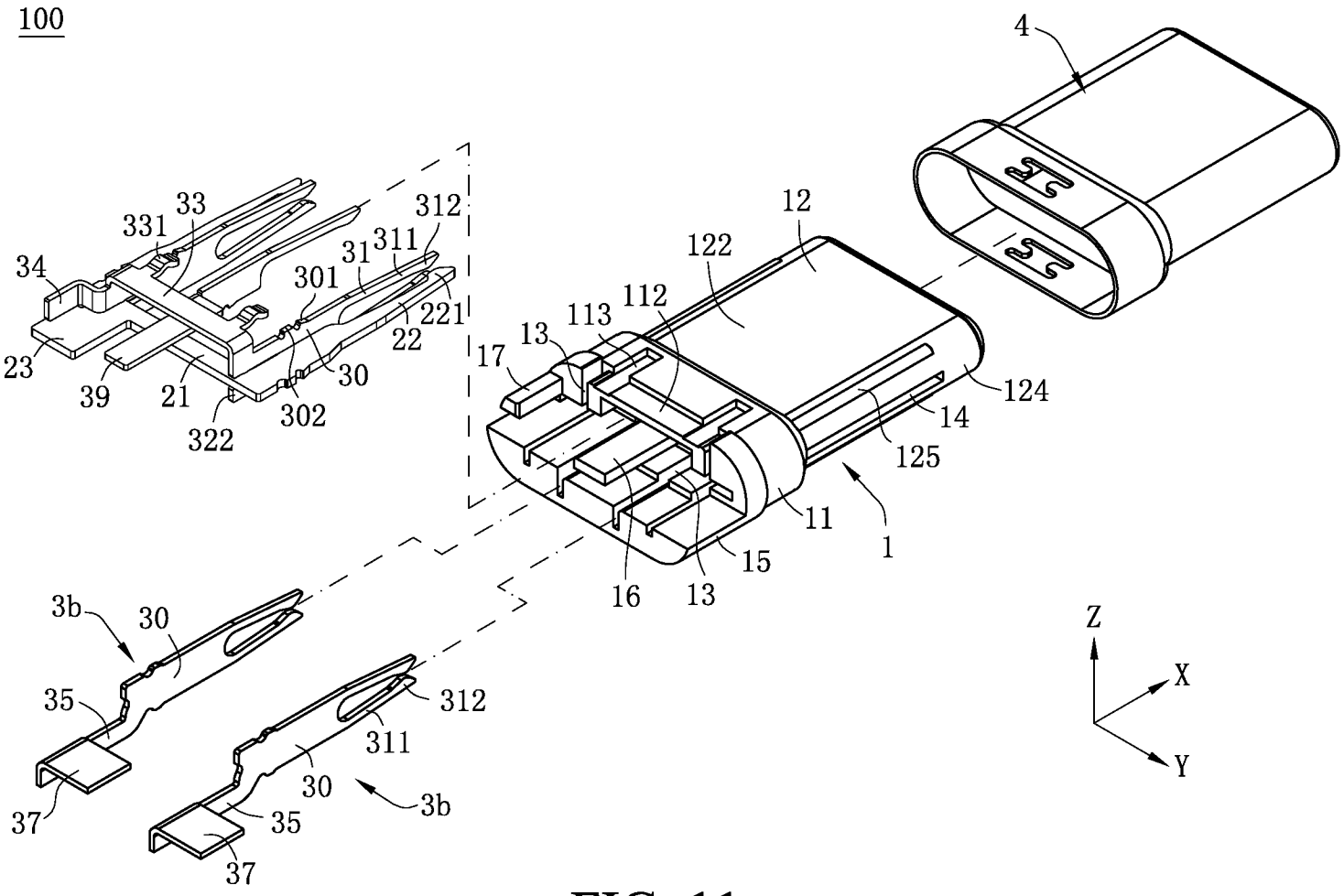
FIG. 11 is a schematic three-dimensional exploded view of a fourth embodiment of a plug connector according to the present invention.
Figure 12:
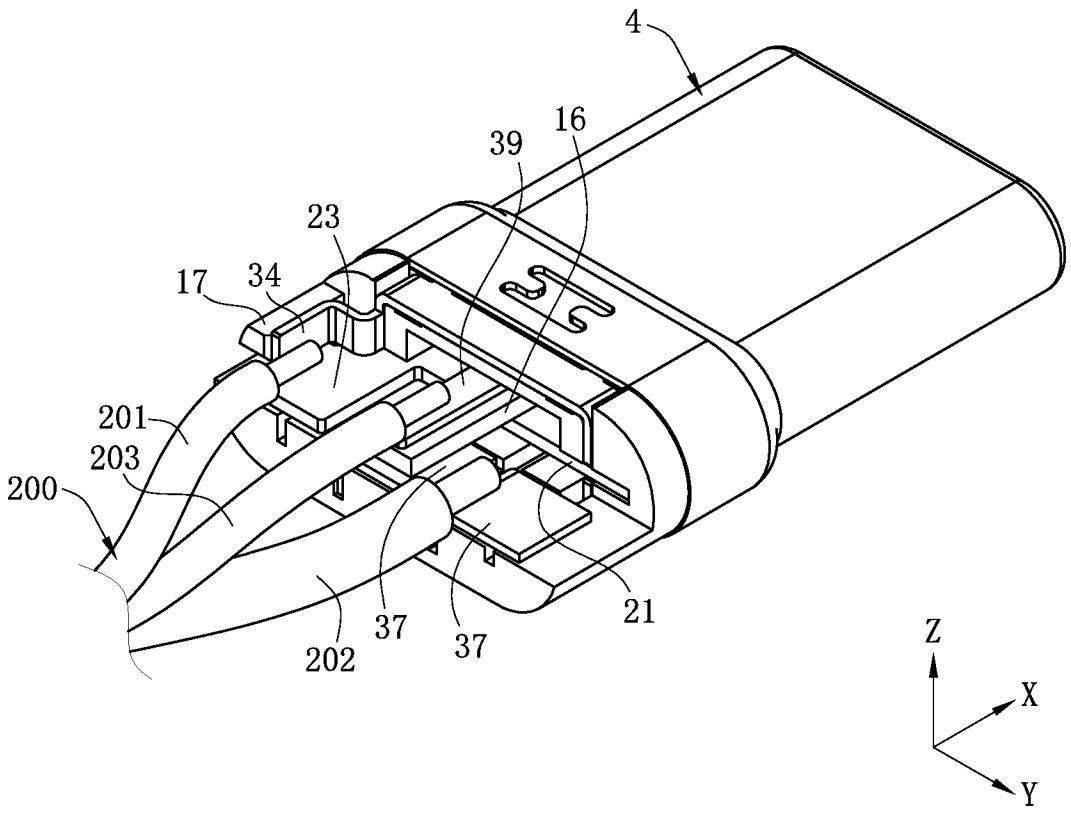
FIG. 12 is a schematic three-dimensional combined view of a plug connector connected to a cable in FIG. 11.

FIG. 11 and FIG. 12 show a plug connector 100 according to a fourth embodiment of the present invention. The structure of the fourth embodiment is basically the same as that of the foregoing first embodiment. Therefore, the same numerals in the figures represent the same structures, and the same structures will not be elaborated. The difference between the structure of the fourth embodiment and the structure of the foregoing first embodiment lies in that: the two power terminals 3*b* are of the same separate structure formed by blanking. In this case, the second tail portions 35 extend backward across the connecting portion 21, and the second soldering portion 37 is formed by bending toward the same side of the second tail portion 35 of each of the two power terminals 3*b* in the left-right direction. The two power terminals 3*b* are arranged side by side in the left-right direction, and a gap (not shown) is provided between the two second soldering portions 37. The cable 200 has only one power wire 202. In this case, the power wire 202 is placed above the gap, and is electrically connected to the two second soldering portions 37 via tin material (not shown) at the same time.

Figure 13:
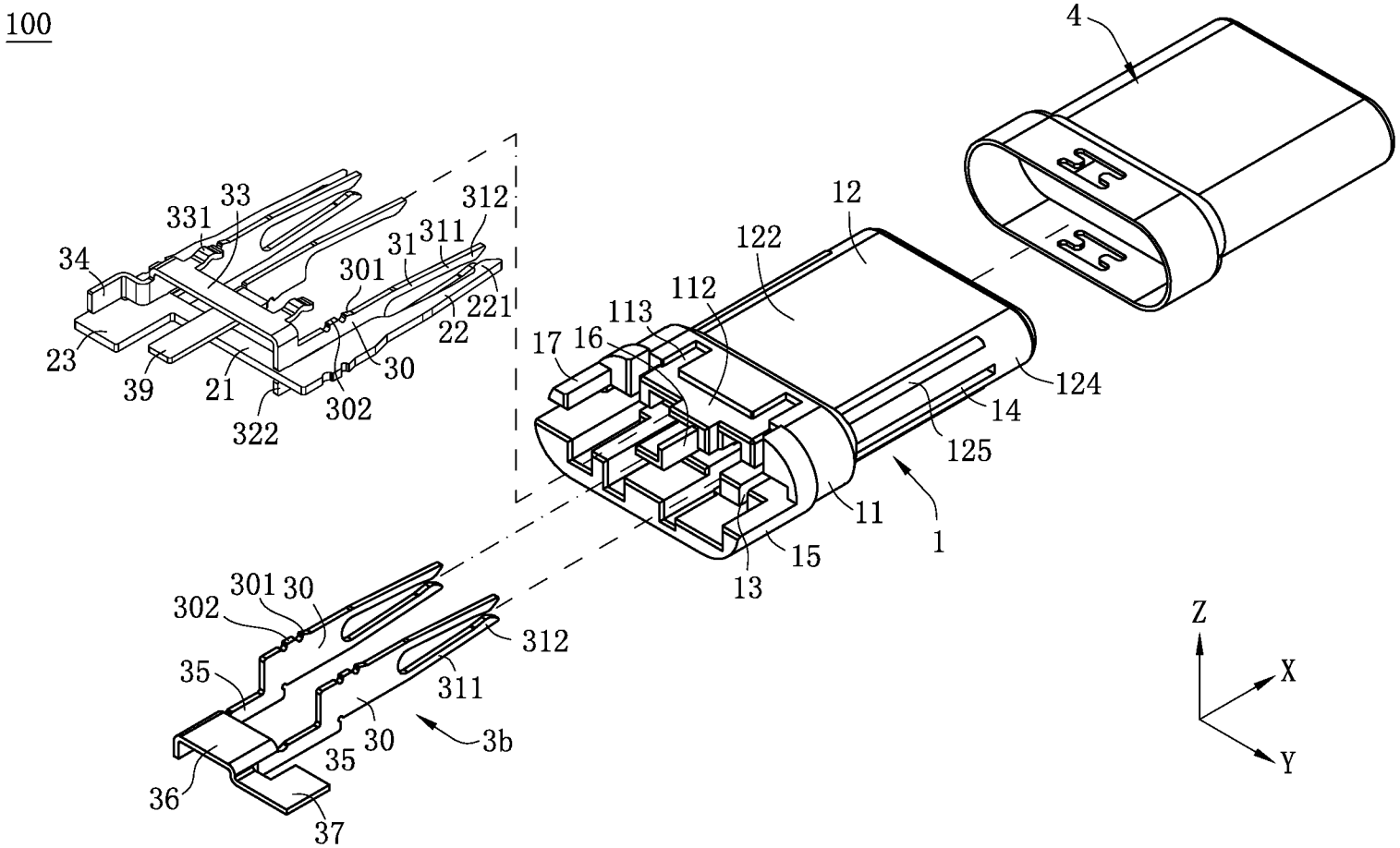
FIG. 13 is a schematic three-dimensional exploded view of a fifth embodiment of a plug connector according to the present invention.
Figure 14:
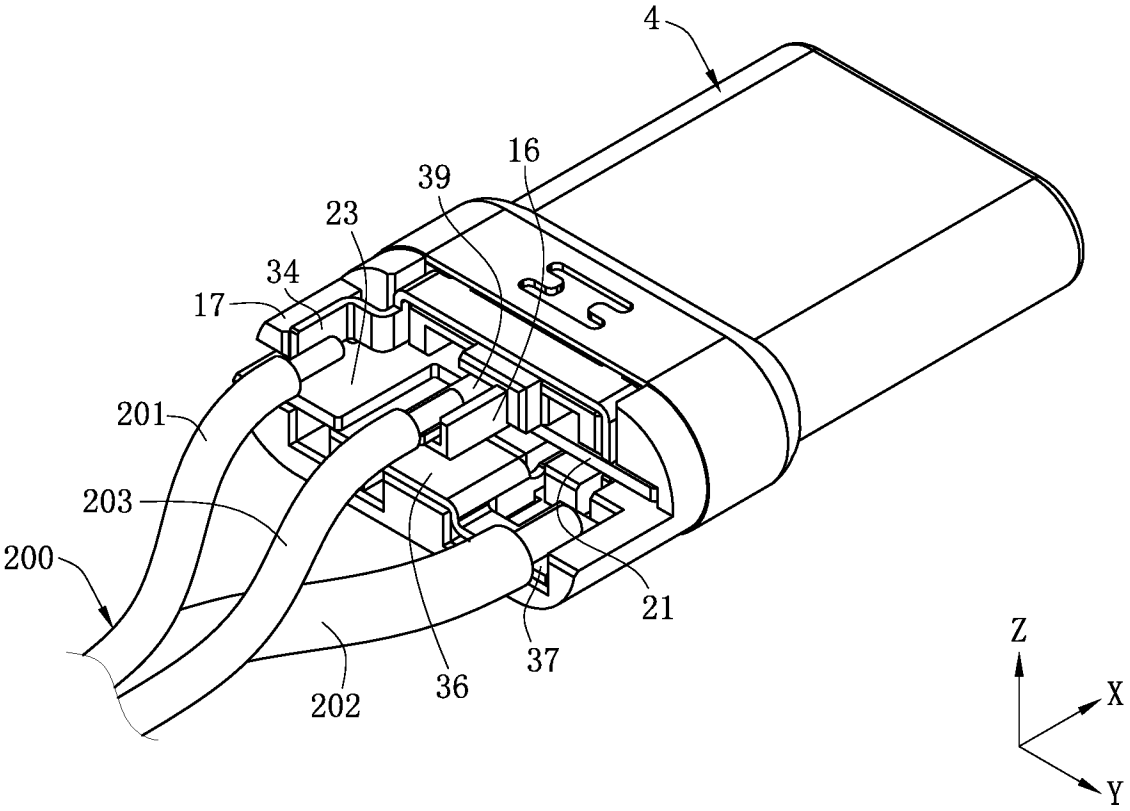
FIG. 14 is a three-dimensional combined view of a plug connector connected to a cable in FIG. 13.

FIG. 13 and FIG. 14 show a plug connector 100 according to a fifth embodiment of the present invention. The structure of the fifth embodiment is basically the same as that of the foregoing first embodiment. Therefore, the same numerals in the figures represent the same structures, and the same structures will not be elaborated. The difference between the structure of the fifth embodiment and the structure of the foregoing first embodiment lies in that: the second tail portions 35 extend backward across the connecting portion 21, and the crossbeam portion 36 is located behind the connecting portion 21. The second soldering portion 37 is formed by extending from one side of a rear end of the crossbeam portion 36, and the second soldering portion 37 is formed by extending in the left-right direction.

In conclusion, the plug connector according to certain embodiments of the present invention, among other things, has the following beneficial advantages:

1. A good ground path between the ground terminals 3*a* and the latch member 2 may be maintained by the contact between the first tail portions 32 and the connecting portion 21 or the locking arms 22 in the up-down direction to form electrical connection. The latch member 2 is provided with the locking portions 221 protruding and extending into the mating slot 121 to engage with the buckling slots of the tongue of the mating socket connector, and therefore the plug connector 100 not only has a locking function, but also forms the good ground path between the latch member 2 and the ground terminals 3*a*.

2. The clamping arms 322 are elastic, and elastically urge against the connecting portion 21 or the positioning protrusion portions 222 in the up-down direction, such that the two ground terminals 3*a* may be in tight contact with the latch member 2, thus keeping a good ground path therebetween. Moreover, the first tail portions 32 are suspended in the terminal slots 13, such that deformation spaces are provided for the clamping arms 322 in the terminal slots 13.

3. The first tail portions 32 are suspended in the terminal slots 13, and the fixing portions 30 are located in front of the first tail portions 32, such that when the clamping arms 322 elastically urge against the connecting portion 21 or the positioning protrusion portions 222 in the up-down direction, an acting force therebetween will not affect the correct positions of the ground terminals 3*a*.

4. The plate surfaces of the first soldering portion 23, the second soldering portion 37 and the third soldering portion 39 are all arranged horizontally in planes at different heights, such that the ground wire 201, the power wires 202 and the detection wire 203 can be soldered with the foregoing soldering portions by reasonably utilizing an effective space at the rear end of the insulating body 1.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A plug connector, comprising:

an insulating body, a mating portion being provided in a front end of the insulating body, and a mating slot being recessed in the mating portion from front to back;

at least one ground terminal, having a contacting portion disposed at one end thereof and protruding and extending into the mating slot, and a first tail portion disposed at the other end thereof, wherein a plate surface of the first tail portion is arranged vertically, and the first tail portion has an opening; and a latch member, having a connecting portion and two locking arms located on two sides of the connecting portion and electrically connected to the connecting portion wherein the connecting portion is located at the opening and is in contact with the first tail portion, wherein the first tail portion is in contact with the connecting portion in an up-down direction to form electrical connection, the two locking arms are located on two sides of the mating portion and respectively have a locking portion protruding and extending into the mating slot, and the locking portions are used for engaging with a buckling slot of a tongue of a mating socket connector.

2. The plug connector of claim 1, wherein the opening is formed by recessing forward from a rear edge of the first tail portion, a clamping arm is formed at the first tail portion and located at each of an upper side and a lower side of the opening, and the clamping arms urge against the connecting portion.

3. The plug connector of claim 2, wherein the clamping arms elastically urge against the connecting portion.

4. The plug connector of claim 2, wherein a protrusion protrudes from each of the clamping arms to inside of the opening and urges against the connecting portion.

5. The plug connector of claim 1, wherein the opening is formed by recessing forward from a rear edge of the first tail portion and penetrating through an upper edge or a lower edge of the first tail portion.

6. The plug connector of claim 5, wherein the first tail portion elastically urges against the connecting portion.

7. The plug connector of claim 1, wherein the at least one ground terminal is formed by blanking a sheet metal, and has a fixing portion connected to a front end of the first tail portion, a plate surface of the fixing portion is arranged vertically, the insulating body is provided with at least one terminal slot, the fixing portion is retained in the terminal slot, and the first tail portion is suspended in the terminal slot.

8. The plug connector of claim 7, wherein the at least one ground terminal comprises two ground terminals arranged symmetrically in a left-right direction on the insulating body, each of the ground terminals is of a tuning fork type terminal structure, and the two ground terminals are electrically connected at the first tail portion via a bridging portion.

9. The plug connector of claim 7, wherein a stab and a boss are arranged adjacently on at least one of an upper side and a lower side of each of the fixing portions, and the stab and the boss are respectively in interference fit with the terminal slot.

10. The plug connector of claim 1, wherein the latch member further comprises a first soldering portion extending from the connecting portion, exposed at a rear end of the insulating body, and used for being soldered with a ground wire.

11. The plug connector of claim 10, wherein the locking arms and the first soldering portion are located in a same plane.

12. The plug connector of claim 10, wherein the at least one ground terminal further comprises a conducting portion extending from the first tail portion, and located on one side of the first soldering portion in the up-down direction, and the conducting portion, the first soldering portion and the ground wire are soldered.

13. The plug connector of claim 12, wherein a limiting block is arranged at the rear end of the insulating body, located on an outer side of the conducting portion, and used for limiting the conducting portion from deflection outward.

14. The plug connector of claim 10, further comprising at least one power terminal and a detection terminal, wherein the power terminal has a second soldering portion exposed at the rear end of the insulating body, the detection terminal has a third soldering portion exposed at the rear end of the insulating body, and the first, second and third soldering portions are located in planes at different heights in the up-down direction.

15. The plug connector of claim 10, wherein the latch member is provided with a material connecting portion at the connecting portion, and the material connecting portion and the first soldering portion are connected to different positions at a rear end of the connecting portion.

16. The plug connector of claim 1, further comprising two power terminals symmetrically arranged in a left-right direction, wherein the two power terminals are electrically connected via a crossbeam portion, the crossbeam portion is located in front of the connecting portion, and a second soldering portion is formed by extending backward from the crossbeam portion and across the connecting portion.

17. The plug connector of claim 1, further comprising two power terminals symmetrically arranged in a left-right direction, wherein the two power terminals are electrically connected via a crossbeam portion, the crossbeam portion is located behind the connecting portion, and a second soldering portion is formed by extending outward from one side of the crossbeam portion, in a left-right direction.

18. The plug connector of claim 1, further comprising a metal shell sheathed outside the insulating body, wherein an open slot is provided in each of two sides of the mating portion and accommodates corresponding one of the locking arms, and protruding ribs protrude from an outer surface of the mating portion are located above and below each of the open slots, and are in interference fit with the metal shell.

19. A plug connector, comprising:

an insulating body, a mating portion being provided in a front end of the insulating body, and a mating slot being recessed in the mating portion from front to back;

two ground terminals arranged on the insulating body, each of the ground terminals having a first contacting portion disposed at one end thereof and protruding and extending into the mating slot, and a first tail portion disposed at the other end thereof; and a latch member, having two locking arms located on two sides of the mating portion, each locking arm having a locking portion protruding and extending into the mating slot, the locking portions being used for engaging with a buckling slot in a corresponding side of a tongue of a mating socket connector, wherein each of the first tail portions is in contact with the corresponding one of the locking arms in an up-down direction to form electrical connection, a plate surface of the first tail portions are perpendicular to plate surfaces of the locking arms, wherein the plate surfaces of the first tail portions are arranged vertically, each of the first tail portions has an opening, the two locking arms extend toward each other to form positioning protrusion portions, the positioning protrusion portions are located at rear ends of the locking arms, and the positioning protrusion portions are respectively located at the openings and are in contact with the first tail portions.

20. The plug connector of claim 19, wherein each of the openings is formed by recessing forward from a rear edge of corresponding one of the first tail portion, a clamping arm is formed at corresponding one of the first tail portions and located at each of an upper side and a lower sides of corresponding one of the openings, and the clamping arms respectively urge against the positioning protrusion portions.

21. The plug connector of claim 20, wherein the clamping arms respectively elastically urge against the positioning protrusion portions.

22. The plug connector of claim 20, wherein a protrusion protrudes from each of the clamping arms to inside of corresponding one of the openings and urges against corresponding one of the positioning protrusion portions.

23. The plug connector of claim 19, wherein each of the openings is formed by recessing forward from a rear edge of the first tail portion and penetrating through an upper edge or a lower edge of the first tail portion.

24. The plug connector of claim 23, wherein each of the first tail portions elastically urges against corresponding one of the positioning protrusion portions.

25. The plug connector of claim 19, wherein each of the ground terminals is formed by blanking a sheet metal, and has a fixing portion connected to a front end of corresponding one of the first tail portion, plate surfaces of the fixing portions are arranged vertically, the insulating body is provided with at least one terminal slot, the fixing portions are retained in the terminal slot, and the first tail portion is suspended in the terminal slot.

26. The plug connector of claim 25, wherein each of the ground terminals is of a tuning fork type terminal structure, the two ground terminals are symmetrically arranged in a left-right direction on the insulating body, and electrically connected at the first tail portions via a bridging portion.

27. The plug connector of claim 25, wherein a stab and a boss are arranged adjacently on at least one of an upper side and a lower side of each of the fixing portions, and the stab and the boss are respectively in interference fit with the terminal slot.

28. The plug connector of claim 19, wherein a connecting portion is connected between the two locking arms, and a first soldering portion extends from the connecting portion, is exposed at the rear end of the insulating body, and is used for being soldered with a ground wire.

29. The plug connector of claim 28, further comprising a detection terminal and two power terminals arranged symmetrically and connected electrically, wherein the two power terminals has a second soldering portion exposed at the rear end of the insulating body, the detection terminal has a third soldering portion exposed at the rear end of the insulating body, and the first, second and third soldering portions are located in planes at different heights in the up-down direction.

30. The plug connector of claim 28, further comprising two power terminals symmetrically arranged in a left-right direction, wherein the two power terminals are electrically connected via a crossbeam portion, a connecting portion is electrically connected between the two locking arms, the crossbeam portion is located in front of the connecting portion, and a second soldering portion is formed by extending backward from the crossbeam portion and across the connecting portion.

31. The plug connector of claim 19, further comprising a metal shell sheathed outside the insulating body, wherein an open slot is provided in each of two sides of the mating portion and accommodates the corresponding locking arm, and protruding ribs protrude from an outer surface of the mating portion, are located above and below the each of the open slots, and are in interference fit with the metal shell.

* * * * *